US012203733B2

(12) United States Patent
Italia

(10) Patent No.: US 12,203,733 B2
(45) **Date of Patent: *Jan. 21, 2025**

(54) LOW LETHAL PROJECTILE SYSTEM

(71) Applicant: Richmond Italia, Mobile, AL (US)

(72) Inventor: Richmond Italia, Mobile, AL (US)

( * ) Notice: Subject to any disclaimer, the term of this patent is extended or adjusted under 35 U.S.C. 154(b) by 110 days.

This patent is subject to a terminal disclaimer.

(21) Appl. No.: 18/091,439

(22) Filed: Dec. 30, 2022

(65) Prior Publication Data

US 2024/0035787 A1 Feb. 1, 2024

Related U.S. Application Data

(63) Continuation-in-part of application No. 17/875,952, filed on Jul. 28, 2022, now Pat. No. 11,808,552.

(51) Int. Cl.
*F42B 5/145* (2006.01)
*F42B 5/073* (2006.01)
(Continued)

(52) U.S. Cl.
CPC ..... *F42B 12/36* (2013.01); *F42B 5/073* (2013.01); *F42B 5/145* (2013.01); *F42B 12/34* (2013.01);
(Continued)

(58) Field of Classification Search
CPC .. F42B 5/02; F42B 5/045; F42B 5/067; F42B 5/073; F42B 5/145; F42B 7/02; F42B 8/02; F42B 8/12; F42B 8/14; F42B 8/16; F42B 12/36; F42B 12/367; F42B 12/40; F42B 12/46; F42B 12/34; F42C 19/083
(Continued)

(56) References Cited

U.S. PATENT DOCUMENTS 5,035,183 A * 7/1991 Luxton ..... F42B 12/40 473/577
6,041,712 A * 3/2000 Lyon ..... F42B 12/745 102/444
(Continued)

FOREIGN PATENT DOCUMENTS

JP 7358494 B2 * 10/2023 ..... F42B 12/34
WO WO-2006111719 A1 * 10/2006 ..... F42B 12/34

OTHER PUBLICATIONS

Machine translation of JP 7358494 B2 (Year: 2023).*

*Primary Examiner* — James S Bergin
(74) *Attorney, Agent, or Firm* — AdamsIP, LLC; Edward Brinkley Garner, III; James Hunter Adams

(57) ABSTRACT

A system and method for a modular, low lethal projectile is provided. The modular, low lethal projectile system comprises an exterior shell, propellant cartridge, and a projectile assembly. A propellant mounting area is arranged at a rear end of the exterior shell and is offset from a center of the exterior shell. A propellant cartridge is secured within the propellant mounting area. A firing pin of a firearm is configured to strike an edge of a cartridge primer of the propellant cartridge, which ignites a primer material and propellant within the propellant cartridge. The resulting hot, expanding gasses propel the projectile assembly form the firearm, and upon contact with a desired target, the capsule tube of the projectile assembly breaks, distributing an effective compound into the air around the desired target.

20 Claims, 10 Drawing Sheets

(51) Int. Cl.

| | |
|---|---|
| ***F42B 12/34*** | (2006.01) |
| ***F42B 12/36*** | (2006.01) |
| ***F42B 12/40*** | (2006.01) |
| ***F42B 12/46*** | (2006.01) |
| ***F42B 12/50*** | (2006.01) |
| ***F42C 19/08*** | (2006.01) |
| *F42B 5/32* | (2006.01) |

(52) U.S. Cl.
CPC ..... *F42B 12/40* (2013.01); *F42B 12/46* (2013.01); *F42B 12/50* (2013.01); *F42C 19/083* (2013.01); *F42B 5/32* (2013.01)

(58) Field of Classification Search
USPC ..... 102/430
See application file for complete search history.

(56) References Cited

U.S. PATENT DOCUMENTS

| | | | | |
|---|---|---|---|---|
| 6,782,828 | B2 * | 8/2004 | Widener | F42B 7/10 102/444 |
| 7,086,337 | B2 * | 8/2006 | Klein | F42B 12/36 102/370 |
| 7,526,998 | B2 * | 5/2009 | Vasel | F42B 12/46 102/370 |
| 8,327,767 | B2 * | 12/2012 | Lafortune | F42B 8/02 102/446 |
| 9,157,715 | B1 * | 10/2015 | Lafortune | F42B 12/40 |
| 11,333,468 | B2 * | 5/2022 | Willson | F42B 12/02 |
| 11,808,552 | B1 * | 11/2023 | Italia | F42C 19/083 |
| 2024/0035786 | A1 * | 2/2024 | Italia | F42B 12/40 |
| 2024/0035788 | A1 * | 2/2024 | Italia | F42B 14/067 |

* cited by examiner

LOW LETHAL PROJECTILE SYSTEM

CROSS REFERENCES

This application is a continuation in part of and claims the benefit of U.S. application Ser. No. 17/875,952, filed on Jul. 28, 2022, which application is incorporated herein by reference.

FIELD OF THE INVENTION

The present invention relates generally to a modular, low lethal projectile system.

BACKGROUND

In 2021, approximately 694,050 violent crimes were reported in the US. As such, it is not unreasonable for one to want to carry a firearm for protection. However, some states and/or municipalities have made it very difficult to obtain carry permits for lethal weapons that may be used for self-defense, including many high population density cities that have a history of high violent crime rates. An alternative to lethal weapons, such as firearms, is non-lethal weapons, including stun guns and pepper spray. However, firearm advocates would be quick to point out that these alternatives are inferior to firearms for self-defense for multiple reasons. Additionally, many self-defense experts say that simply showing a firearm to one's attacker can actually act as a deterrent since many victims of violent crimes are seen as easy targets. Therefore, there is a very strong psychological component to self-defense that current non-lethal weapons can't trigger in the same way lethal firearms can regardless of how much easier it is to obtain non-lethal weapons.

On the other hand, though law enforcement are able to carry lethal weapons for use in the line of duty, they must be very careful to determine when it is appropriate to use lethal force non-lethal force. This is especially true when trying to establish order during chaotic situations, such as riots and domestic violence incidents. Various tools, equipment, and weapons are deployed by law enforcement to help immobilize violent offenders and unruly mobs, but even non-lethal weapons currently used by law enforcement have resulted in fatalities as well as severe physical trauma. In particular, rubber/polymer slugs and beanbags fired from shotguns have been responsible for numerous deaths and trauma, particularly when they strike the head and neck areas of a target.

One of the more common forms of a non-lethal weapon used for crowd control comprises gas powered firearms (such as air guns and/or paintball guns) configured to propel chili powder filled projectiles at a target. When the chili powder filled projectile strikes a target, it breaks, resulting in the chili powder being dispersed throughout the immediate surroundings. The suspended chili powder burns people's eyes, faces, and noses, causing said people to experience a choking feeling that can leave them unable to breath. This in turn results in said people ceasing their unruly behavior co that order may be restored. Unfortunately, gas powered firearms require an air tank and a loading system, which is needed in addition to other firearms law enforcement personnel might be carrying. Further, some gas-powered firearms don't work as well in colder weather due to the liquified gas under high pressure leaking into the gas powered firearm through the regulator, which can ultimately result in misfires and damage to the gas powered firearm.

Accordingly, a need exists in the art for an improved low lethal projectile system that can be fired from traditional firearms.

SUMMARY

A modular, low lethal projectile system configured to fire from traditional firearms is provided. In one aspect, the system of the present disclosure is configured to allow a user to easily create customized, non-lethal projectiles that will have consistent results. In another aspect, the system is configured to be used with lethal firearms in situations where non-lethal force is desired. In yet another aspect, the system is configured to such that only modular, low lethal projectile may be loaded into firearms. In yet another aspect, the system is configured to reduce the chance of injury by providing a shell configured to shatter upon impact. Generally, the system of the present disclosure is configured to provide a modular, low lethal projectile that can be used with both lethal firearms and non-lethal firearms.

The modular, low lethal projectile system generally comprises exterior shell, propellant cartridge, and projectile assembly. The exterior shell preferably comprises an outer wall, internal structure, first internal cavity, and second internal cavity. A first opening on an expulsion end of said exterior shell allows for access to the first internal cavity and a second opening on a rear end allows for access to the second internal cavity. A projectile mounting area of the first internal cavity allows for the mounting of a projectile therein whereas a propellant mounting area of the second internal cavity allows for the mounting of a propellant cartridge therein. Materials that may be used to create the exterior shell include, but are not limited to, polymer, metal, or any combination thereof. In a preferred embodiment, the exterior shell is made of injection molded polymer.

The propellant cartridge preferably comprises a cartridge primer, hollow casing, wadding, and propellant. The cartridge primer may comprise a cylindrical cup, a primer mixture, and an anvil, wherein the cylindrical cup comprises a cylindrical base, interior sidewall, and exterior sidewall. The primer mixture is disposed on the cylindrical base of the cylindrical cup in a way such it is interposed between the lower surface of the anvil and the cylindrical base of the cylindrical cup. The anvil of the cartridge primer may be located in the cylindrical cup and may comprise an upper surface, lower surface, and side surface. In a preferred embodiment, the anvil may be part of the sidewall in a way such that the anvil is a part of the cylindrical cup. A striking surface may be formed with a portion of the cylindrical base of the cylindrical cup, wherein the striking surface is adjacent to a portion of the primer material that is interposed between the lower surface of the anvil and the cylindrical base of the cylindrical cup. In this way, striking the exterior surface of the cylindrical cup may cause the anvil to ignite the primer material. In a preferred embodiment, the propellant cartridge is a rimfire blank.

The propellant cartridge is composed of a capsule tube and a sealing member. The capsule tube is preferably an injection-molded polymer tube with a closed end and an open end, wherein said open end is opposite said closed end and is configured to so that an effective composition may be added to an internal cavity of said capsule tube. The sealing member secures to the open end of the capsule tube and seals off the open end so that no effective composition can be removed. The capsule tube is preferably configured in a way such that it shatters when the propellant cartridge is ejected from the exterior shell and strikes a target. When shattered in this manner, the effective composition loaded within the capsule tube is spread out or attached to the target. Substances that may act as the effective composition include, but are not limited to, irritant powder, irritant liquid, irritant gas, therapeutic powder, therapeutic liquid, marking powder, marking liquid, particles with deterrent effects, or their combinations.

The foregoing summary has outlined some features of the system and method of the present disclosure so that those skilled in the pertinent art may better understand the detailed description that follows. Additional features that form the subject of the claims will be described hereinafter. Those skilled in the pertinent art should appreciate that they can readily utilize these features for designing or modifying other structures for carrying out the same purpose of the system and method disclosed herein. Those skilled in the pertinent art should also realize that such equivalent designs or modifications do not depart from the scope of the system and method of the present disclosure.

DESCRIPTION OF THE DRAWINGS

These and other features, aspects, and advantages of the present invention will become better understood with regard to the following description, appended claims, and accompanying drawings where:

DETAILED DESCRIPTION

In the Summary above and in this Detailed Description, and the claims below, and in the accompanying drawings, reference is made to particular features, including method steps, of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with/or in the context of other particular aspects of the embodiments of the invention, and in the invention generally. The term "comprises" and grammatical equivalents thereof are used herein to mean that other components, ingredients, steps, etc. are optionally present. For example, an article "comprising" components A, B, and C can contain only components A, B, and C, or can contain not only components A, B, and C, but also one or more other components.

Figure 1:
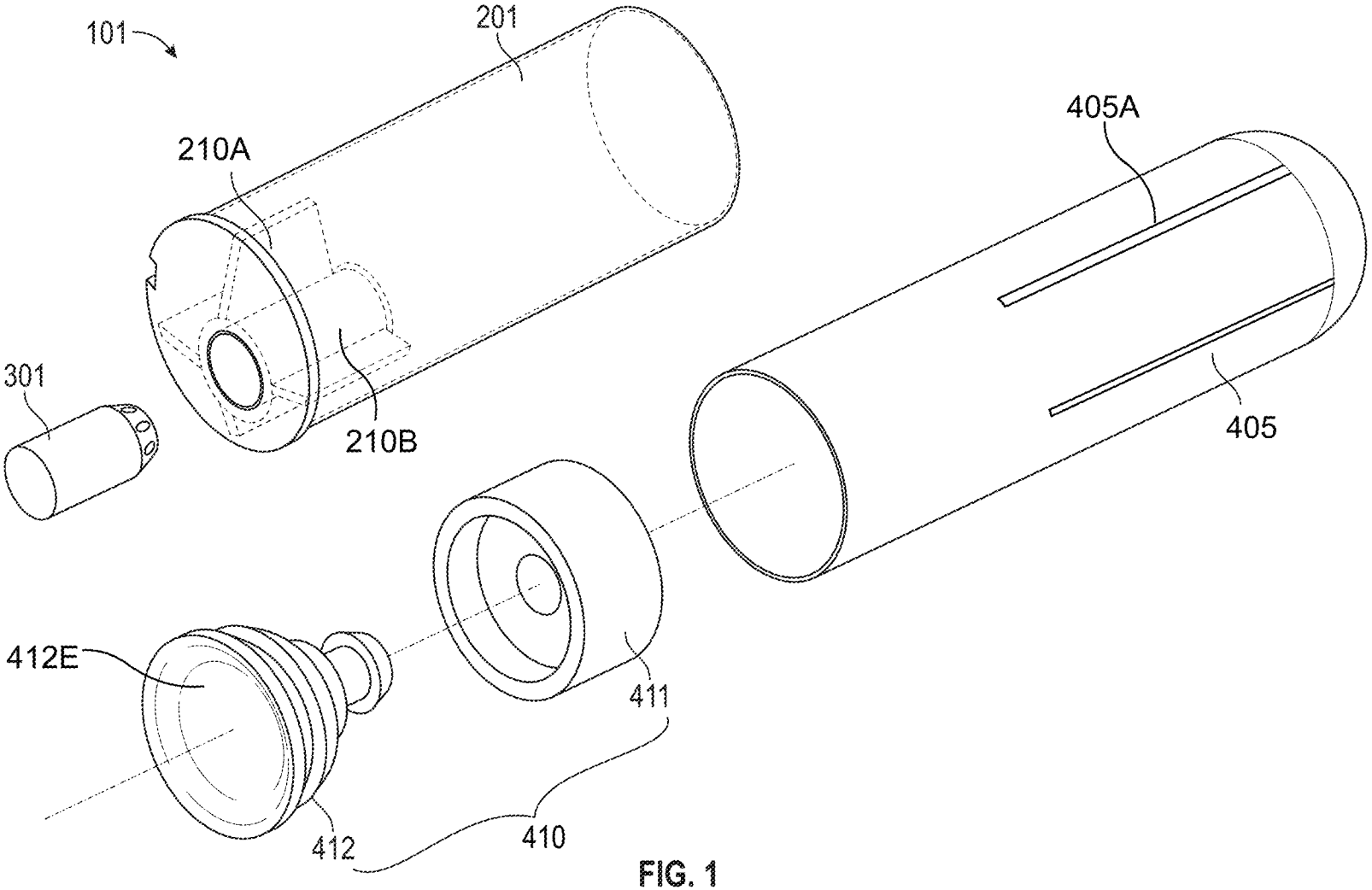
FIG. 1 illustrates a perspective, exploded view of a modular, low lethal projectile system embodying features consistent with the present disclosure.
Figure 2:
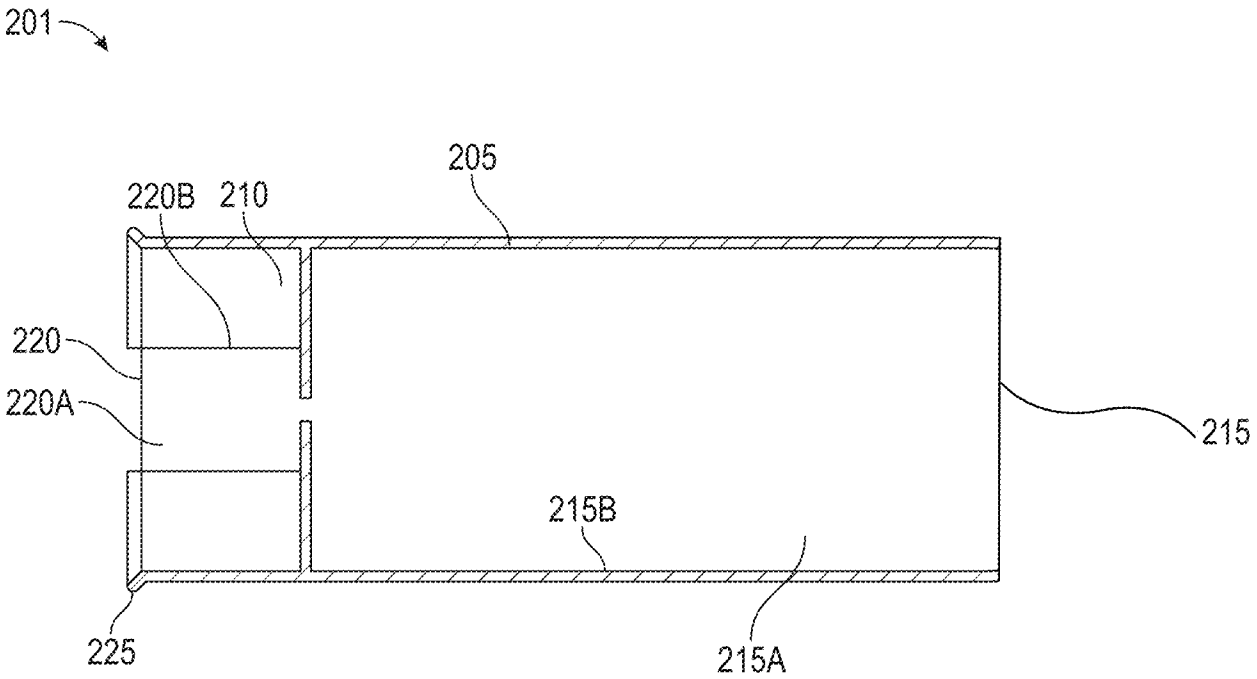
FIG. 2 illustrates a cross-sectional view of an exterior shell of the modular, low lethal projectile system embodying features consistent with the present disclosure.
Figure 3:
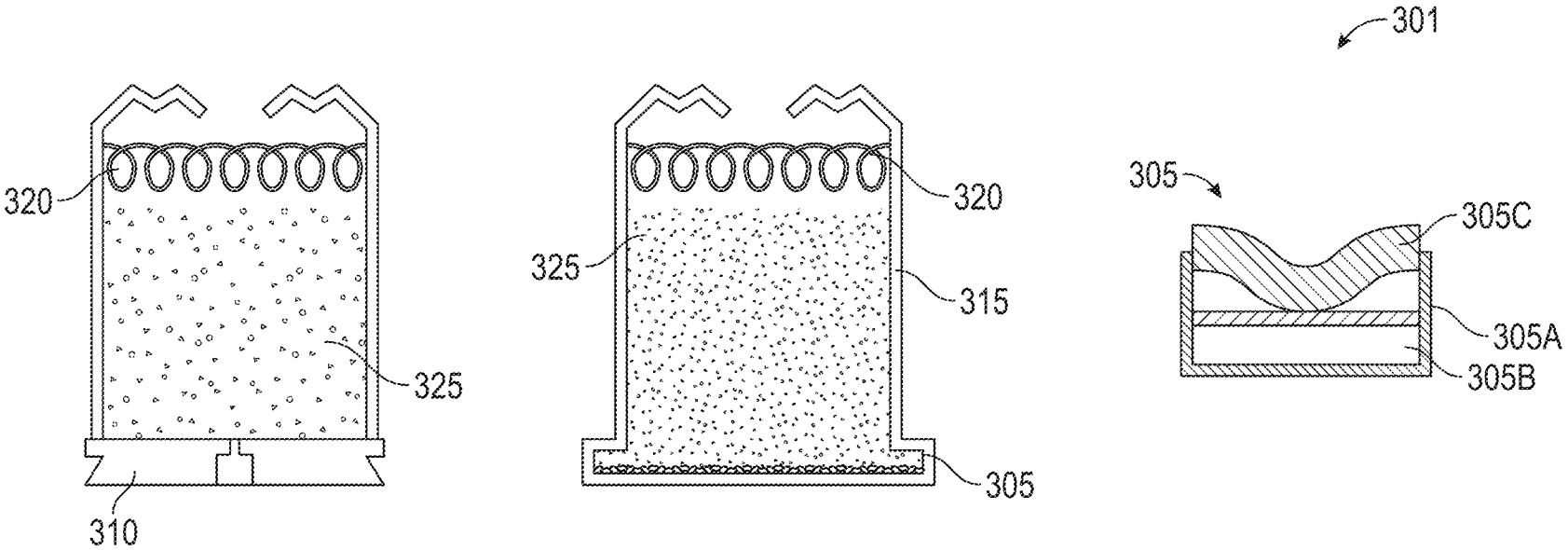
FIG. 3 illustrates a cross-sectional view of a propellant cartridge of the modular, low lethal projectile system embodying features consistent with the present disclosure.
Figure 4:
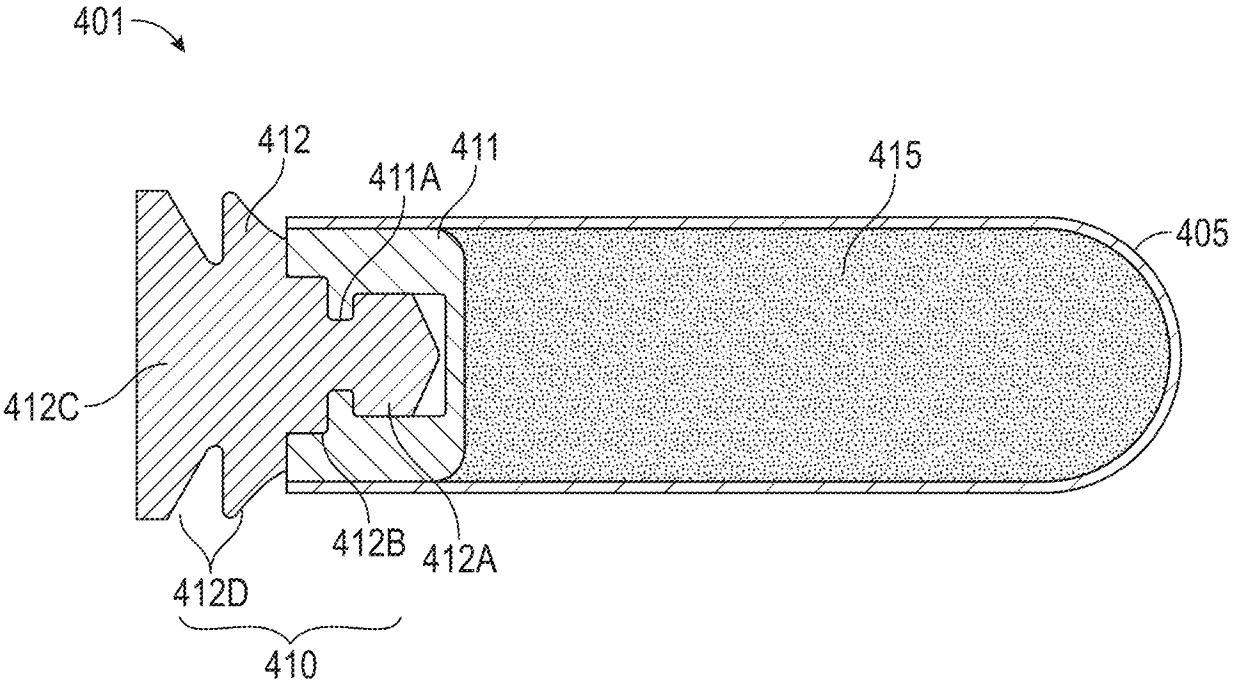
FIG. 4 illustrates a cross-sectional view of a projectile assembly of the modular, low lethal projectile system embodying features consistent with the present disclosure.
Figure 5:
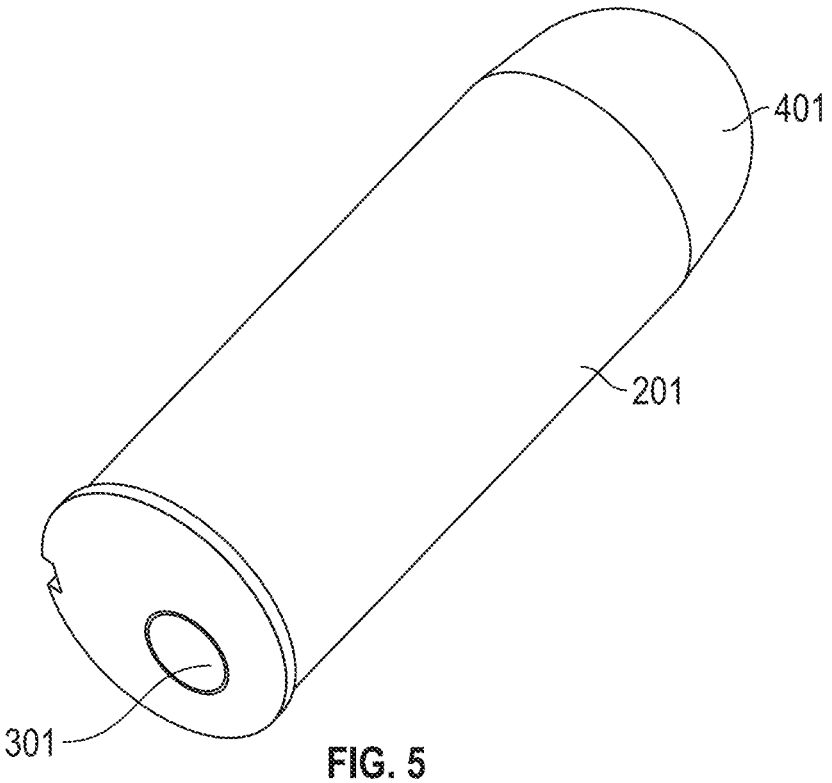
FIG. 5 illustrates a perspective view of an exterior shell, propellant cartridge, and projectile assembly combined to create modular, low lethal projectile system embodying features consistent with the present disclosure.
Figure 6:
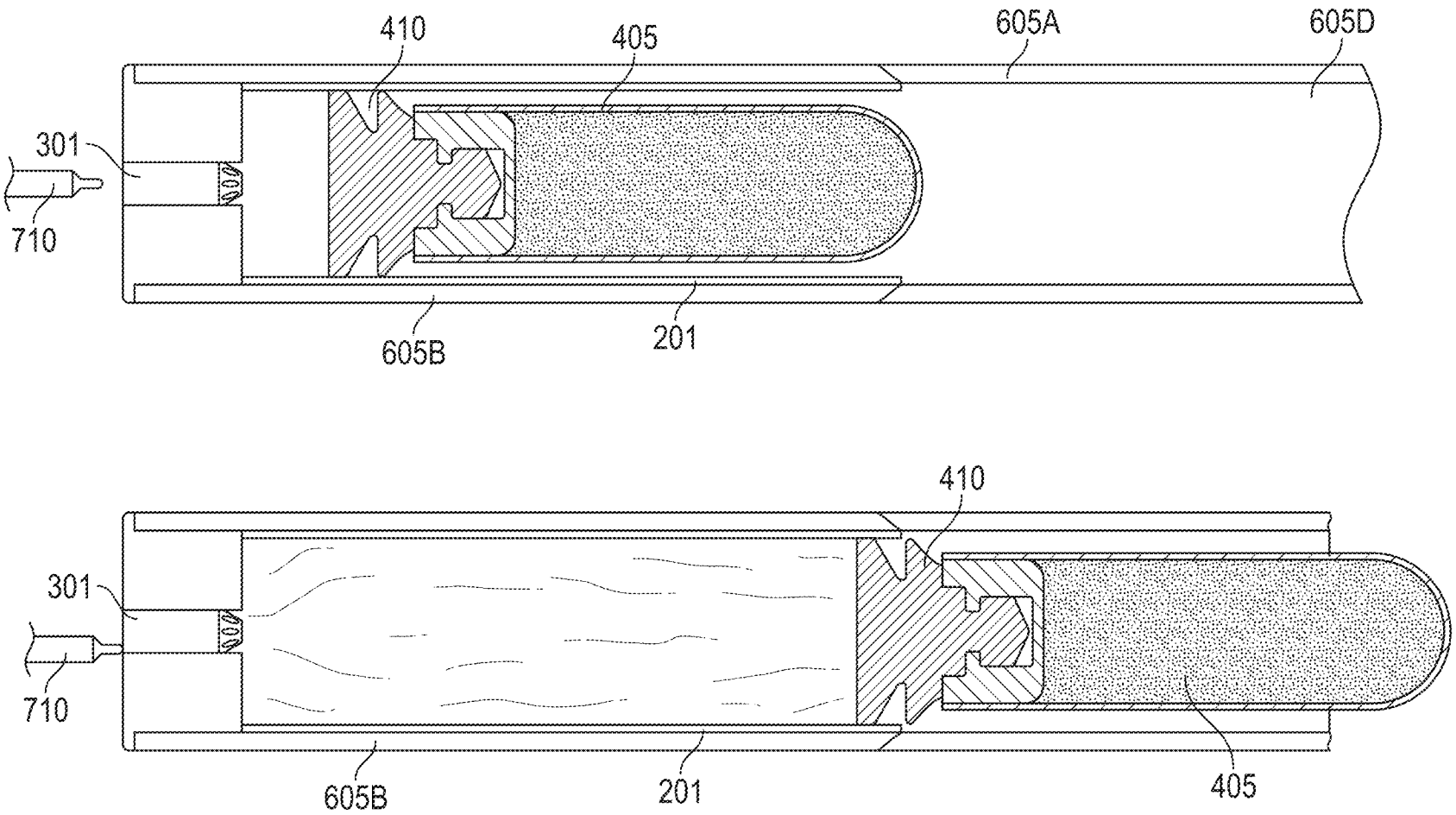
FIG. 6 illustrates a cross-sectional view of a modular, low lethal projectile system within a firearm and embodying features consistent with the present disclosure.
Figure 7:
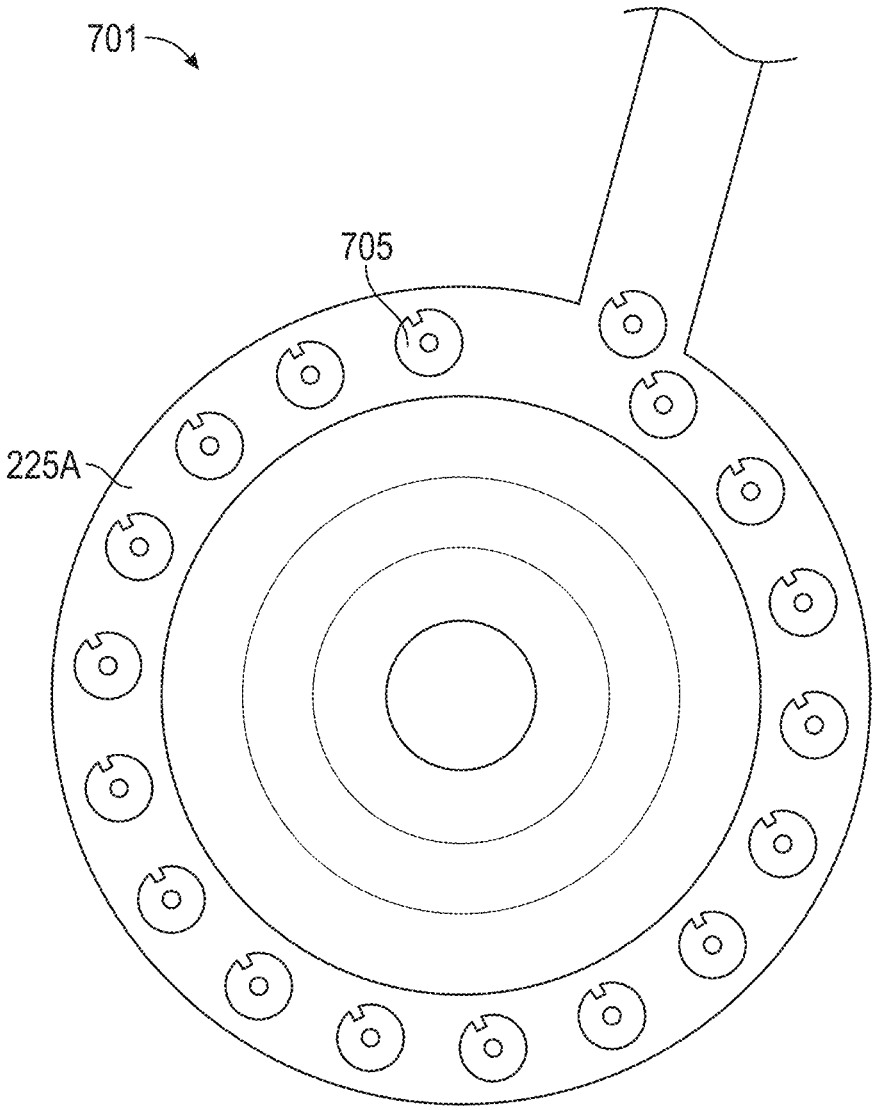
FIG. 7 illustrates an environmental view of a modular, low lethal projectile system being loaded within a magazine and embodying features consistent with the present disclosure.
Figure 8:
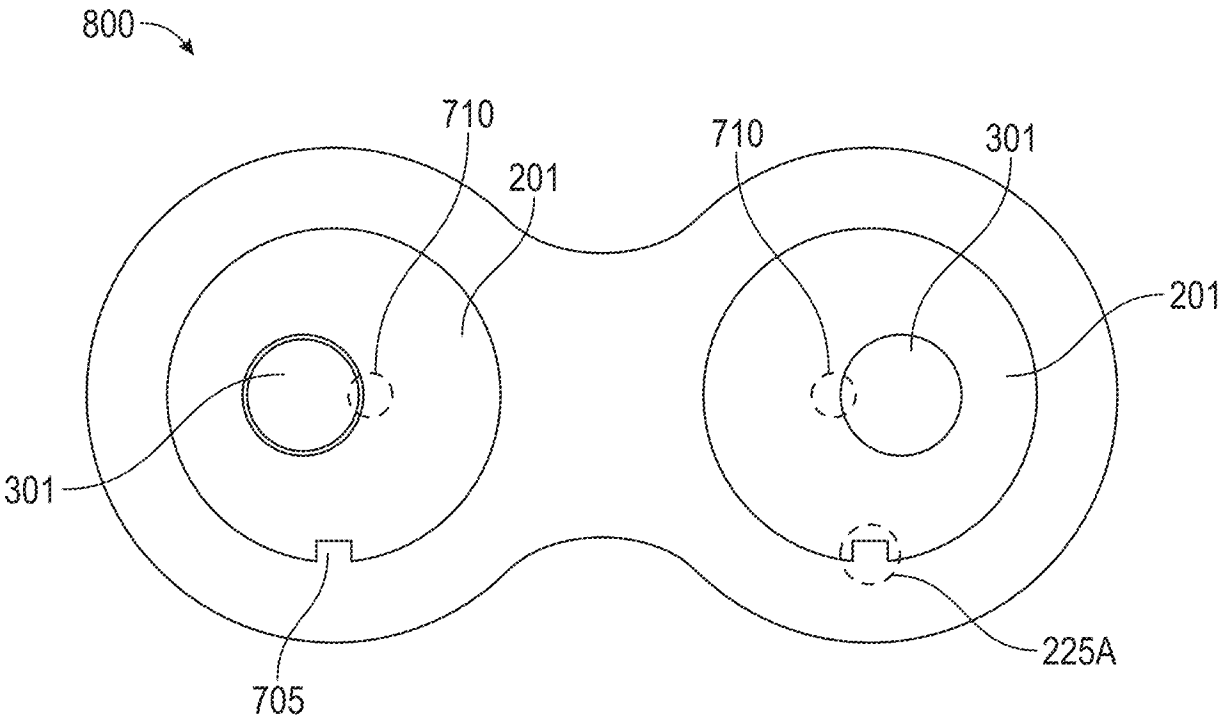
FIG. 8 illustrates a rear, cross-sectional view of a modular, low lethal projectile within the chamber of a firearm and embodying features consistent with the present disclosure.
Figure 9:
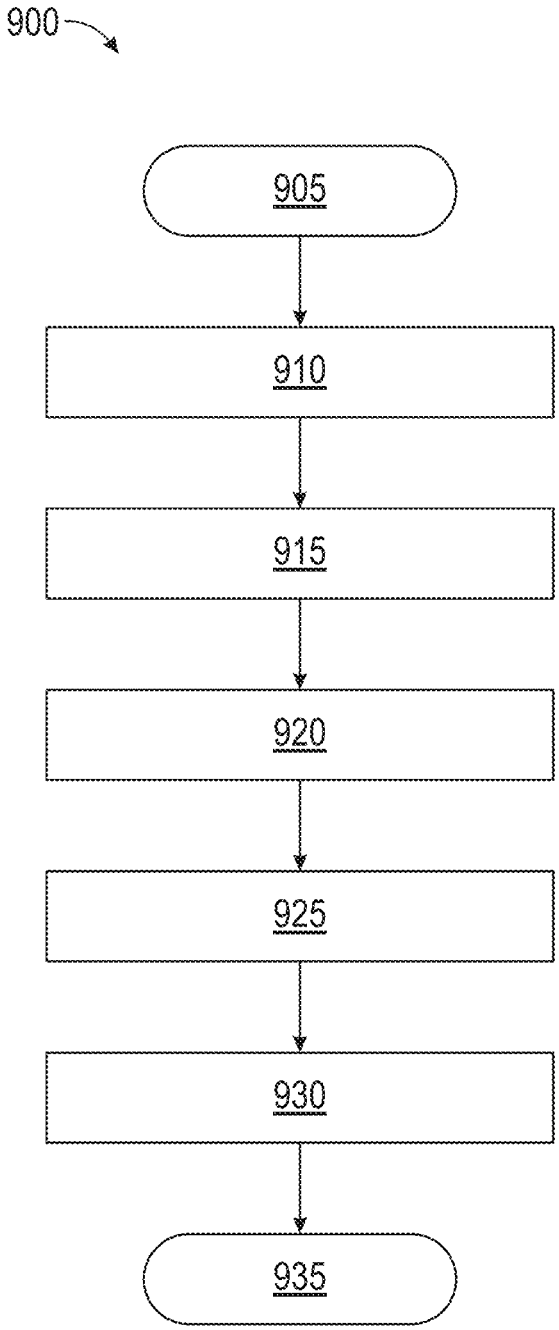
FIG. 9 illustrates a flow chart outlining certain method steps of a method embodying features consistent with the principles of the present disclosure.
Figure 10:
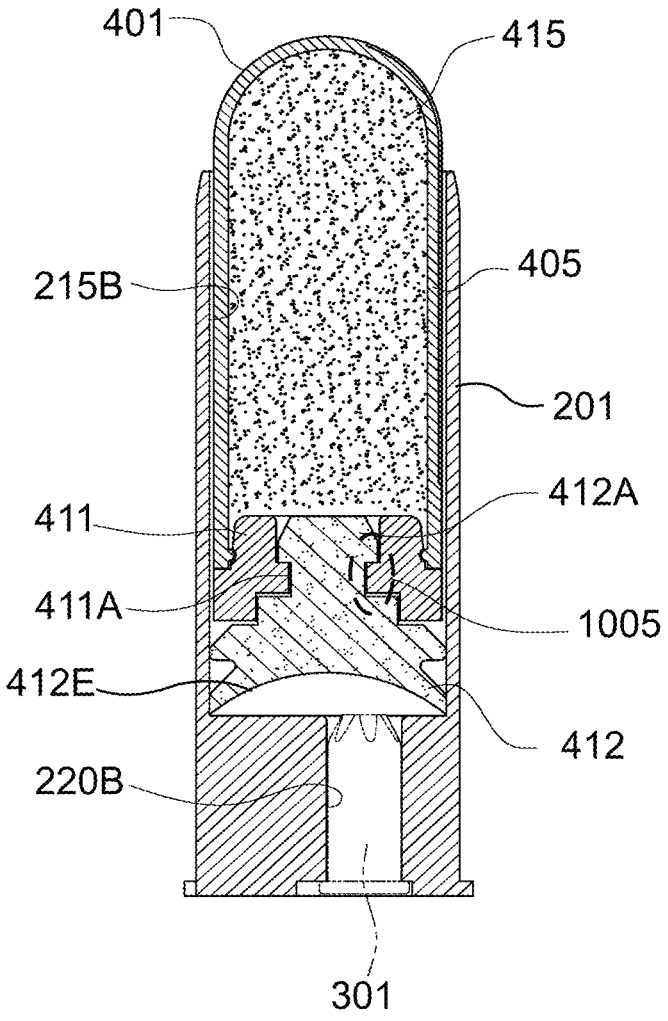
FIG. 10 illustrates a cross-sectional view of a projectile assembly of the modular, low lethal projectile system embodying features consistent with the present disclosure.

FIGS. 1-10 illustrate the system 100 and method of a modular, low lethal projectile system 100. FIG. 1 depicts an exploded view of a modular, low lethal projectile system 100 having an exterior shell 201, propellant cartridge 301, and projectile assembly 401. FIG. 2 depicts a cross-sectional view of the exterior shell 201. FIG. 3 depicts a cross-sectional view of the propellant cartridge 301. FIG. 4 depicts a cross-sectional view of the projectile assembly 401. FIG. 5 depicts a perspective view of the modular, low lethal projectile system 100. FIG. 6 depicts a cross-sectional view of a modular, low lethal projectile system 100 within a firearm 601. FIG. 7 depicts an environmental view of a modular, low lethal projectile system 100 being loaded within a magazine 701 configured to fire only exterior shells 201 having a notch 225A on its projecting rim 225. FIG. 8 depicts a rear cross-sectional view of a modular, low lethal projectile system 100 loaded within the chambers of a double-barreled shotgun, wherein the cartridge primer 305 and firing pins 710 are concentrically aligned. FIG. 9 illustrates a method that may be carried out by a user of the modular, low lethal projectile system 100. FIG. 10 depicts a cross-sectional view of a modular, low lethal projectile system 100. It is understood that the various method steps associated with the methods of the present disclosure may be carried out by a user using the modular, low lethal projectile system 100 depicted in FIGS. 1-8 and 10.

As illustrated in FIGS. 1-8 and 10, the modular, low lethal projectile system 100 generally comprises an exterior shell 201, propellant cartridge 301, and projectile assembly 401. Since the propellant cartridge 301 is disposed on the exterior shell 201 eccentrically, the firing pin 710 of the launcher strikes the propellant cartridge 301 in an eccentric manner. Thus the projectile assembly 401 is only fired but not inserted into or penetrating the human body or animal's body. Thereby the present projectile system 100 is low lethal.

As illustrated in FIG. 2, the exterior shell 201 acts as a casing configured to support the propellant cartridge 301 and projectile assembly 401 of the modular, low lethal projectile system 100. In a preferred embodiment, the exterior shell 201 has a cylindrical shape and is made of polymer; however, the exterior shell 201 may comprise other shapes and materials without departing from the inventive subject matter described herein. Other materials that the external shell may comprise includes, but is not limited to, steel, copper, aluminum, or any combination thereof. In one preferred embodiment, the polymer based exterior shell 201 is formed using injection molding.

The exterior shell 201 preferably comprises an outer wall 205, internal structure 210, first internal cavity 215A, and second internal cavity 220A. A first opening 215 on an expulsion end of said exterior shell 201 allows for access to the first internal cavity 215A and a second opening 220 on a rear end of said exterior shell 201 allows for access to the second internal cavity 220A. A projectile mounting area 215B of the first internal cavity 215A allows for the mounting of a projectile assembly 401 therein whereas a propellant mounting area 220B of the second internal cavity 220A allows for the mounting of a propellant cartridge 301 therein. In a preferred embodiment, a projectile assembly 401 may be inserted into said first internal cavity 215A via said first opening 215 and positioned within said first internal cavity 215A in a way such that the projectile assembly 401 is seated above a top point of the internal structure 210 of the exterior shell 201 and against said projectile mounting area 215B. The propellant cartridge 301 may be inserted into said second internal cavity 220A via said second opening 220 and positioned within said second internal cavity 220A in a way such that the propellant cartridge 301 is seated below the top point of the internal structure 210 of the exterior shell 201 and mounted against said propellant mounting area 220B defined by said internal structure 210. In a preferred embodiment, as illustrated in FIG. 8, the second opening 220 and propellant mounting area 220B are offset from the center of the rear end of the exterior shell 201 in a way such that a firing pin 710 of a centerfire firearm 601 may strike the edge of a cartridge primer of the propellant cartridge 301 no matter the how the modular, low-lethal projectile system 100 is positioned within the chamber 605B so long as the cartridge primer is facing the firing pin 710.

As illustrated in FIG. 2, the internal structure 210 of the exterior shell 201 defines the propellant mounting area 220B and separates the first internal cavity 215A from the second internal cavity 220A. The internal structure 210 preferably extends from the rear end of the exterior shell 201 towards said top point located between said rear end and said expulsion end. The internal structure 210 comprises an internal wall 210A and support structure 210B, wherein said internal wall 210A creates the propellant mounting area 220B, wherein said support structure 210B is situated between the outer wall 205 of the exterior shell 201 and the internal wall 210A of the support structure 210B. The support structure 210B of this design serves multiple purposes. Because the support structure 210B is not solid, the amount of shrinkage that occurs is reduced for embodiments of the exterior shell 201 that are injection molded, resulting in more consistent results when the modular, low lethal projectile system 100 is fired from a firearm 601. Additionally, the internal structure 210 reduces the amount of give on the rear end of the exterior shell 201 due to the support structure 210B reinforcing the rear end of the exterior shell 201. Further, in some embodiments, the internal structure 210 provides a clear boundary between the projectile mounting area 215B and the propellant mounting area 220B. As illustrated in FIG. 2, the internal structure 210 preferably has a length that is longer than a propellant cartridge 301 positioned within the second internal cavity 220A and against the propellant mounting area 220B, providing gasses with at least a minimum chamber in which to expand. An aperture of said internal structure 210 allows for fluid communication between the first internal cavity 215A and second internal cavity 220A.

As illustrated in FIG. 3, the propellant cartridge 301 preferably comprises a cartridge primer 305, casing base 310, hollow casing 315, wadding 320, and propellant 325. The cartridge primer 305 may comprise a cylindrical cup 305A, a primer material 305B, and an anvil 305C. The cylindrical cup 305A may comprise a cylindrical base, interior sidewall, and exterior sidewall. The primer material 305B may be disposed on the cylindrical base of the cylindrical cup 305A in a way such that the primer material 305B is interposed between the lower surface of the anvil 305C and the cylindrical base of the cylindrical cup 305A. The anvil 305C of the cartridge primer 305 may be located in the cylindrical cup 305A and may comprise of a lower surface for the cylindrical base to make contact. In a preferred embodiment, the anvil 305C may be part of the cylindrical cup 305A. Alternatively, the anvil 305C may not be a part of the cylindrical cup 305A but be separate from it. In another preferred embodiment, the lower surface of the anvil 305C is protruded towards the cylindrical base of the cylindrical cup 305A. A striking surface may be formed with a portion of the cylindrical base of the cylindrical cup 305A, wherein the striking surface is adjacent to a portion of the primer material 305B that is interposed between the lower surface of the anvil 305C and the cylindrical base of the cylindrical cup 305A. In this way, striking the exterior surface of the cylindrical cup 305A may cause the anvil 305C to ignite the primer material 305B. In a preferred embodiment, the anvil 305C of the cartridge primer 305 is ring shaped and positioned about the edges of the cylindrical cup 305A in a way that forms a rimfire cartridge primer.

The casing base 310 may comprise a top surface, bottom surface, and a sidewall. The bottom surface of the casing base 310 may be configured to accept an at least one cartridge primer 305. In the preferred embodiment, as shown in FIG. 3, the cartridge primer 305 is seamlessly incorporated into the casing base 310. The casing base 310 may further comprise at least one hole extending through the casing base 310 from the top surface to the bottom surface. When a user operates the firearm 601 in a way to cause the hammer to strike the firing pin 710, the firing pin 710 may subsequently strike the exterior surface of the cartridge primer 305 held within or a part of said casing base 310. This may cause the striking surface of the cartridge primer 305 to engage the lower surface of the anvil 305C, thus igniting the adjacent primer materials 305B held within the cylindrical cup 305A. The at least one hole allows the ignited primer materials 305B of the cartridge primer 305 to move from the bottom surface to the top surface and into the propellant 325.

The hollow casing 315 is preferably incorporated into the cartridge primer 305 in a way such that the cartridge primer 305 and hollow casing 315 create a propellant cartridge 301 in the form of a rimfire casing. The exterior surface of the propellant cartridge 301 may have a groove where the casing base 310 and hollow casing 315 connect. The hollow casing 315 may comprise a cylindrical portion that defines a bottom end and a tapered section that defines a top end. In a preferred embodiment, the top end of the hollow casing 315 may remain open so that the propellant cartridge 301 may be filled with propellant 325 and wadding 320. In another preferred embodiment, the tapered section may have a continuous cylindrical wall extending outwardly from the open top end to the cylindrical portion. The cylindrical portion may have a continuous cylindrical wall extending vertically from said tapered section to said casing base 310.

In a preferred embodiment, the propellant cartridge 301 has a base diameter of about 0.278 inches (in), casing diameter of about 0.226 in, and casing length of approximately 0.613 inches, which is approximately the base diameter, casing diameter, and casing length of a .22 Long Rifle casing. The neck diameter of the propellant cartridge 301 is preferably configured in a way such that it is secured against the propellant mounting area 220B when the propellant cartridge 301 is placed within the second internal cavity 220A. In a preferred embodiment, the neck diameter is no more than 1 millimeter wider than the diameter of the second opening 220. However, one with skill in the art will appreciate that the propellant cartridge 301 may comprise of any base diameter, shoulder width, height, and neck diameter that will allow for a propellant 325 to ignite within the propellant cartridge 301 and allow for the resulting hot, expanding gasses to transfer from the propellant cartridge 301 (located within the second internal cavity) to the first internal cavity 215A with minimal to no losses.

As mentioned previously, the propellant cartridge 301 may be substantially filled with a propellant 325 that deflagrates upon ignition of the at least one cartridge primer 305. Upon deflagration of the propellant 325, the interior of the propellant cartridge 301 may fill with hot, expanding gasses. As the gasses expand, pressure may build within the propellant cartridge 301. Because the wadding 320 is configured to plug the propellant cartridge 301, pressure may build behind the wadding 320 before expanding into the first internal cavity 215A. As pressure builds within the first internal cavity 215A, it may lead to the expulsion of the projectile assembly 401 from the exterior shell 201 and through a borehole 605D of a barrel assembly 605 of a firearm 601. Because of the design of the projectile assembly 401, high pressures may build behind the projectile within the exterior shell 201, allowing a user to use less propellant 325 to obtain higher projectile assembly 401 velocities. A lower amount of propellant 325 may create a larger amount of unfilled space within the propellant cartridge 301 for the propellant 325 to react, which may increase the efficiency in which propellant 325 deflagrates within the propellant cartridge 301 and the chamber 605B of the barrel assembly 605.

As illustrated in FIG. 4, the projectile assembly 401 is composed of a capsule tube 405 and a sealing member 410. The capsule tube 405 is preferably an injection-molded polymer tube with a closed end and an opposite open end configured to allow for the loading of effective compositions 415 therein. The closed end is preferably rounded, and the open end comprises an aperture for loading said effective compositions 415, as illustrated in FIG. 4. The sealing member 410 secures to the open end of the capsule tube 405 and seals off the aperture so that no effective composition 415 can be removed via said aperture. The capsule tube 405 is preferably configured in a way such that it shatters when the projectile assembly 401 is ejected from the exterior shell 201 and strikes a target. In a preferred embodiment, a plurality of shallow grooves 405A of an outer surface of the capsule tube 405 allows for said capsule tube 405 to more easily break when the projectile assembly 401 reaches a target. When shattered in this manner, the effective compositions 415 loaded within the capsule tube 405 are spread out or attached to the target. Substances that may act as the effective composition 415 include, but are not limited to, irritant powder, irritant liquid, irritant gas, therapeutic powder, therapeutic liquid, marking powder, marking liquid, particles with deterrent effects, or their combinations.

In a preferred embodiment, the effective composition 415 is a capsaicin rich powder, such as chili powder. For instance, as illustrated in FIG. 8, a projectile assembly 401 filled with a capsaicin rich powder fired from a shotgun may strike the target, resulting in the capsule tube 405 shattering and suspending the capsaicin rich powder in the air. People/animals within a certain distance of the shattered capsule tube 405 may react to the suspended, capsaicin rich powder and experience irritation to their skin, eyes, nose, and lungs. As such, capsaicin rich powder may be an especially effective composition 415 for use as a riot control agent with the preferred embodiment of the modular, low lethal projectile system 100 as described herein. In other preferred embodiment, the effective composition 415 may comprise medicinal powder used for treatment of animal skin disorders. When a capsule tube 405 comprising medicinal powder is fired from a firearm 601 and shatters, the medicinal powder releases and attaches to the animal, allowing for the treatment of animals having skin diseases at a safe distance. In some preferred embodiments, the capsule tube 405 may also comprise a tracer compound, wherein said tracer compound is also loaded via the open end of the capsule tube 405. When a capsule tube 405 comprising a tracer is fired from a firearm 601 and shatters, the tracer releases and attaches to the target, allowing law enforcement personnel to pursue targets more easily during any subsequent chase due to distinctive markings created by said tracer.

As illustrated in FIG. 4, the sealing member 410 comprises a capsule plug 411 and a buffer unit 412. The capsule plug 411 may be secured to the capsule tube 405 at the open end of the capsule tube 405, which may be combined to create a sealed projectile assembly 401, wherein a catch located on said walls of said capsule tube at said open end is configured to secure to a groove of said capsule plug in order to hold said capsule plug within said aperture, as illustrated in FIG. 10. The buffer unit 412 of the sealing member 410 preferably comprises a tapered portion 412A, notched portion 412B, and main body 412C. The notched portion 412B is situated between the tapered portion 412A and main body 412C and is configured to secure the buffer unit 412 to the capsule plug 411. The tapered portion 412A is tapered in a way such that an aperture end of said tapered portion 412A may fit within a cavity of the capsule plug 411 via the insertion hole 411A of said capsule plug 411. This tapered section along with the notched portion 412B secures the buffer unit 412 to the capsule plug 411. Additionally, the tapered portion 412A is preferably tapered in a way such that it is easier for a user to force the buffer unit 412 into the capsule plug 411. In a preferred embodiment, the maximum outer diameter of the tapered portion 412A is a bit larger than a diameter of the insertion hole 411A. So the capsule plug 411 and the buffer unit 412 will not separate from each other easily due the way in which the tapered portion 412A and notched portion 412B interact with the insertion hole 411A and cavity of the capsule plug 411 (see 1005 in FIG. 10).

The main body 412C of the buffer unit 412 preferably comprises at least two conical sealing sections 412D that are configured to make substantial contact with the projectile mounting area 215B of the exterior shell 201. The at least two conical sealing sections 412D prevent expanding gasses from pushing past the projectile assembly 401 and into the barrel body 605A. As such, the at least two conical scaling sections 412D ensure that pressure builds up behind the projectile and subsequently propels the projectile assembly 401 out the exterior shell 201 and barrel body 605A of the firearm 601 from which it is fired. Additionally, some preferred embodiments of the at least two conical sealing sections 412D may be configured in a way such that at least one contacts the barrel body 605A as the sealed projectile assembly 401 is propelled through the barrel body 605A. When a top conical sealing section is configured in such a way, it may prevent gasses from escaping around the projectile as it moves from the exterior shell 201 and into the barrel body 605A since the top conical scaling section will make contact with the bore of the barrel body 605A prior to the bottom conical sealing section losing contact with the exterior shell 201, as illustrated in FIG. 6. The at least two conical sealing sections 412D will also ensure that expanding gasses remain substantially behind the projectile assembly 401 as it moves down the barrel body 605A, increasing the efficiency in which the gasses are able to eject the projectile assembly 401 from the firearm 601, as illustrated in FIG. 6. In a preferred embodiment, the buffer unit 412 is made of rubber having high strength and flexibility; however, other materials, such as silicon and polymer, may be used without departing from the inventive subject matter described herein.

In another preferred embodiment, as illustrated in FIG. 4, the base end of the main body 412C is concave to allow for at least a minimum area of expanding gases within the internal cavity created between the sealed projectile assembly 401 and the top point of the internal structure 210. The concave shape 412E of the base end also creates more surface area for the expanding gasses to apply force to the projectile assembly 401. Further, the concave shape 412E of the base end reduces the weight of the projectile assembly 401, which can both reduce recoil for the user as well as reduce the likelihood of injury to the desired target. However, in some preferred embodiments, a lower weight might not be desired. For instance, the base end of the main body 412C may comprise a flat or convex shape. Further, in other preferred embodiments, the buffer unit 412 may comprise a dense core that is coated in a softer material. Materials that may be used for the dense core include, but are not limited to, dense polymer, dense rubber, metal, or any combination thereof.

As mentioned previously, a projectile assembly 401 may be placed within the first internal cavity 215A of the exterior shell 201 via the first opening 215 of said exterior shell 201. As illustrated in FIG. 6, a portion of the capsule tube 405 is preferably projected out the expulsion end of the exterior shell 201. However, some preferred embodiments of the modular, low lethal projectile system 100 may comprise a projectile assembly 401 seated within the exterior shell 201 in a way such that the capsule tube 405 does not project out the expulsion end. By substantially seating the projectile assembly 401 within the exterior shell 201, the overall length of a modular, low lethal projectile system 100 may be decreased. Additionally, by substantially seating the sealed projectile assembly 401 within the casing, the area in which the gasses are configured to expand is made smaller, allowing for more pressure to build behind the projectile assembly 401 within the exterior shell 201. As such, a propellant cartridge 301 with less powder may be used to achieve the desired effect.

For instance, standard 12-gauge loads may have an average overall length between 2.5 inches and 3.5 inches and a hull rated to withstand a maximum of 11,500 psi pressure created by deflagration of about 20 grains of smokeless powder and 85 grains of black powder. The modular, low lethal projectile system 100 may have an average overall length greater than what the firearm 601 is normally configured to load, which is possible due to the rounded design of the projectile protruding from the expulsion end of the exterior shell 201, as illustrated in FIG. 6. Alternatively, the projectile assembly 401 may be substantially seated within the exterior shell 201 such that the exterior shell 201 is the exact length for which the chamber 605B of the barrel body 605A is designed to handle. As such, one with skill in the art will recognize that a modular, low lethal projectile system 100 may comprise a number of dimensions that may work with firearms 601 without departing from the inventive subject matter as disclosed herein. Further, the exterior shell 201 is preferably rated to withstand more than 11,500 psi pressure created by deflagration of propellant 325 within the propellant cartridge 301, which may increase the number of times the exterior shell 201 may be reused before failure occurs. Additionally, the sealed projectile assembly 401 may reach an exit velocity from the muzzle end of the barrel body 605A that is higher than that of the exit velocity of a projectile for a standard 12-gauge load due to the design of the buffer unit 412. As such, the amount of force transferred to the user due to the kick created by the firearm 601 may be reduced without affecting the ballistics of the cartridge by simply reducing the amount of propellant 325 loaded within the propellant cartridge 301.

In a preferred embodiment, as illustrated in FIG. 7, the system 100 may further comprise a magazine 701. The magazine 701 of the preferred embodiment may be configured to accept one or more modular, low lethal projectile systems 100 and may connect to the firearm 601 via a magazine well in a way such that the magazine 701 may provide the modular, low lethal projectile systems 100 to a loading port and chamber 605B of said firearm 601. The magazine 701 is preferably configured to accept a plurality of modular, low lethal projectile systems 100 that further comprise a projecting rim 225 located around a periphery of a bottom of the rear end of the exterior shell 201 and at least one notch 225A formed on the projecting rim 225, wherein said projecting rim 225 is located on said base of said exterior shell 201. As shown in FIG. 7, the magazine 701 of the firearm 601 is provided with a protrusion 705 corresponding to the notch 225A of the exterior shell 201.

In a preferred embodiment, the magazine 701 is a drum magazine 701. The magazine 701 may comprise a housing, first guide, second guide, sprocket assembly, and magazine 701 spring. The housing protects the plurality of modular, low lethal projectile systems 100 loaded within the housing and holds them in place so that they may be provided to the firearm 601 via the magazine well. The first and second guides are rotatably secured within the housing and are concentric with one another so that cartridges may be inserted therein. In a preferred embodiment, the first guide is configured with a protrusion 705 so that it may only accept exterior shell 201*s* having said notch 225A. The sprocket assembly may rotate the guides within the housing, which causes the modular, low lethal projectiles to be guided to the magazine well and loading port. The magazine 701 spring provides the force that causes the sprocket assembly to rotate. Whenever a modular, low lethal projectile is stripped from the magazine 701 by the firearm 601, the next modular, low lethal projectile system 100 is pushed into position by the magazine 701 spring, sprocket assembly, and guides so that continuous, uninterrupted firing may be achieved.

In another embodiment, the magazine 701 may be a tubular, rotary, pan, or helical magazine 701. In a preferred embodiment, the modular, low lethal projectile systems 100 may stack in a single row within the magazine 701, but one with skill in the art will recognize that the modular, low lethal projectile system 100 may stack within the magazine 701 in any manner without departing from the inventive subject matter as disclosed herein so long as the magazine 701 can provide the firearm 601 with said modular, low lethal projectile system 100 via a magazine well. Additionally, because the preferred embodiment of the magazine 701 requires a protrusion 705, only modular, low lethal projectile systems 100 having said notch 225A may be loaded therein, preventing the loading of ammunition configured to critically wound people. However, the arrangement of the notch 225A on the exterior shell 201 has no effect on the loading of modular, low lethal projectiles in traditional magazines 701 that are currently available. In other words, lethal ammunition currently available cannot be loaded into the preferred embodiment of the magazine 701 described herein but a modular, low lethal projectile systems 100 having a notch 225A can be loaded into traditional magazines 701 configured to fire lethal ammunition.

In order to fire a modular, low lethal projectile systems 100 from a firearm 601, the user preferably applies a force to the propellant cartridge 301 via a firing pin 710 in order to deflagrate the propellant 325 within. In a preferred embodiment, the firing pin 710 may transfer energy from a trigger mechanism of the firearm 601 to the cartridge primer 305 of the propellant cartridge 301. The firing pin 710 may comprise a rod with a striking end and a punching end, wherein said striking end may be struck in a way such that the firing pin 710 may transfer energy to the cartridge primer 305 via the punching end. In a preferred embodiment, the firing pin 710 may be made of a hardened material in order to reduce the chance of the firing pin 710 bending. In another preferred embodiment, the firing pin 710 may be made of a lightweight material to allow for a quicker and more efficient transfer of energy from the firing pin 710 to the cartridge primer 305. For instance, a firing pin 710 made of a titanium alloy may have the qualities of being both hardened and lightweight, whereas a firing pin 710 made of a lightweight polymer may possess the quality of being lightweight but not hardened.

In yet another preferred embodiment, the punching end of the firing pin 710 may be rounded. By rounding the punching end of the firing pin 710, a user may ensure the cartridge primer 305 of the propellant cartridge 301 may be indented rather than pierced, which may reduce the chance that the cartridge primer 305 may fail to ignite. However, one with skill in the art may appreciate that the firing pin 710 may comprise of any shape and any material that may allow the firing pin 710 to transfer a force to a cartridge primer 305 in a way such that the firing pin 710 may ignite the cartridge primer material 305B, which may subsequently deflagrate the propellant 325 of the propellant cartridge 301.

The firing pin 710 may be floating or spring-loaded. The only force acting on a firing pin 710 that is floating is the force transferred to the firing pin 710 from the user. Though the bolt may be stopped by the modular, non-lethal projectile system 100 and chamber 605B, a floating firing pin 710 may continue to move forward within the bolt due to its own inertia. If the firing pin's 610's momentum is great enough, the propellant 325 in the propellant cartridge 301 may be deflagrated after the firing pin 710 causes the cartridge primer material 305B of the at least one cartridge primer 305 to ignite. To lessen the possibility of an unintentional deflagration of the propellant 325, the firing pin 710 may be constructed of a lightweight material. Alternatively, the bolt assembly may further comprise a firing pin 710 spring to make the firing pin 710 spring-loaded. The firing pin 710 spring may be positioned within the bolt body in a way such that the firing pin 710 spring forces the firing pin 710 away from the cartridge primer 305. In a preferred embodiment, the firing pin 710 spring may be weak enough to not significantly impede the transfer of energy from the hammer to the at least one cartridge primer 305 but strong enough to counter the inertia of the firing pin 710 as it moves forward within the bolt body. In this way, the firing pin 710 may only contact the at least one cartridge primer 305 when a force is applied to the firing pin 710 via a component, such as a hammer.

In a preferred embodiment, the exterior shell 201 and a firing pin 710 of a firearm 601 (as the dash line indicated in FIG. 8) are coaxial to each other when the modular, low lethal projectile system 100 is properly seated within the chamber 605B of the firearm 601. Thus a part of an edge of the cartridge primer 305 of the propellant cartridge 301 is corresponding to and overlapped with a part of a surface of the firing pin 710. As such, the firing pin 710 strikes the cartridge primer 305 eccentrically and may do so no matter the position of the cartridge primer 305 relative the firing pin 710 within the chamber 605B. For instance, as illustrated in FIG. 8, the firing pin 710 is still aligned to strike a portion of the surface of the cartridge primer 305 of the propellant cartridge 301 even though the cartridge primer 305 is located in different positions after being properly loaded into the chamber 605B. When the firing pin 710 hits the cartridge primer of the propellant cartridge 301, the cartridge primer material 305B ignites, which in turn causes the propellant 325 inside the propellant cartridge 301 to ignite and generate hot, expanding gasses. These hot, expanding gasses move into the first internal cavity 215A below the projectile assembly 401 and accumulated at a base end of said projectile assembly 401 until pressure forces the projectile assembly 401 from the first internal cavity 215A and into the borehole 605D of the barrel body 605A.

A barrel assembly 605 operably connected to the firing pin 710 may guide the projectile assembly 401 and hot, expanding gasses to a desired target. The barrel assembly 605 may comprise of a barrel body 605A, chamber 605B, and muzzle 605C. The barrel body 605A is the elongated portion of the barrel assembly 605 made of a hardened material comprising a chamber end and muzzle end. A borehole 605D extending from the chamber end to the muzzle end may be configured to allow the projectile assembly 401 to pass from the chamber to the muzzle of the barrel assembly 605. In a preferred embodiment, the diameter of the borehole 605D and dimensional uniformity of the borehole 605D is the same from the chamber end to the muzzle end. In another preferred embodiment, the barrel assembly 605 may be configured to withstand pressures greater than 15,000 pounds per square inch (psi). In yet another preferred embodiment, the barrel assembly 605 may be made of machined steel alloy, carbon fiber, or a combination thereof; however, one with skill in the art may appreciate that the barrel assembly 605 may comprise of any material that may allow the barrel assembly 605 to withstand pressures of greater than 15,000 psi.

The barrel assembly 605 may be configured in a way such that the modular, low lethal projectile system 100 may be inserted into the barrel assembly 605 via the chamber 605B. The chamber 605B is preferably connected to the chamber end of the barrel body 605A and may be configured to house a modular, low lethal projectile system 100 of a particular size so that the modular, low lethal projectile system 100 fits snuggly within the chamber 605B, allowing the firing pin 710 to consistently strike the cartridge primer 305 of the propellant cartridge 301. Upon insertion of a modular, low lethal projectile system 100 into the chamber 605B, a portion of the projectile assembly 401 may be inserted into the chamber end of the borehole 605D, as illustrated in FIG. 6. In a preferred embodiment, a projectile assembly 401 may be inserted up to fifteen millimeters (mm) within the chamber end of the borehole 605D when the modular, low lethal projectile system 100 is inserted into the chamber 605B. As the projectile assembly 401 passes through the borehole 605D, the projectile assembly 401 may gain speed due to the buildup of gasses from the deflagration of the propellant 325 within the chamber 605B and barrel body 605A.

In another preferred embodiment, the borehole 605D may have the same circumference as the at least two conical sealing sections of the buffer unit 412 so the buildup of gasses behind the projectile assembly 401 is increased, thus increasing the pressure behind the projectile and effectively increasing the velocity of the projectile assembly 401 as it passes through the barrel body 605A via the borehole 605D. In yet another preferred embodiment, the muzzle end of the barrel body 605A may comprise helical grooves to cause the projectile assembly 401 to spin as it exits the muzzle end. Preferably, the helical grooves may cause the projectile assembly 401 to perform a full revolution once every twenty-eight inches it travels after exiting the barrel assembly 605. However, the helical grooves may cause the projectile assembly 401 to perform a full revolution as low as once every seven inches or as high as once every thirty-five inches without departing from the inventive subject matter described herein.

FIG. 9 provides a flow chart 900 illustrating certain, preferred method steps that may be used to carry out the method of configuring a modular, low lethal cartridge. Step 905 indicates the beginning of the method. During step 910, the user may obtain an exterior shell, projectile assembly, propellant cartridge, and effective composition. During step 915, the user may fill the capsule tube of the projectile assembly with the effective composition. In some preferred embodiments, the user may also fill the capsule tube with a tracer compound. Once the capsule tube has been filled, the user may secure a sealing member to the aperture of the capsule tube during step 920 in order to create a sealed projectile assembly, which effectively stoppers the effective composition within the tube. In some preferred embodiments, the user may create a plurality of sealed projectile assemblies comprising a plurality of different effective compositions before moving onto subsequent steps. In other embodiments, the effective compositions used to fill a capsule tube of a projectile assembly may vary from projectile assembly to projectile assembly. In other embodiments, a user might precisely measure the amount of effective composition used in each projectile assembly they desire to construct.

Once the user has created the sealed projectile assembly, a user may seat the sealed projectile assembly within the first internal cavity of the exterior shell during step 925, wherein the sealed projectile assembly is secured against the projectile mounting area of said first internal cavity. The user may secure the entire sealed projectile assembly within the exterior shell or only a portion of the exterior shell, depending on the size of the exterior shell relative the scaled projectile assembly as well as the desired size of the expansion chamber created within the exterior shell between the buffer of the sealed projectile assembly and the internal structure. The user may secure the propellant cartridge within the second internal cavity of the exterior shell during step 930, wherein the propellant cartridge is secured against the propellant mounting area of said second internal cavity. The user may proceed to terminate step 935 once the propellant cartridge and sealed projectile assembly are secured within the exterior shell.

The implementations set forth in the foregoing description do not represent all implementations consistent with the subject matter described herein but are examples consistent with the disclosed subject matter. Although variations have been described in detail above, other modifications or additions may be possible. In particular, further features and/or variations may be provided in addition to those set forth herein. For example, the implementations described above may be directed to various combinations and subcombinations of the disclosed features and/or combinations and subcombinations of several further features disclosed above. In addition, the logic flow depicted in the accompanying figures and/or described herein do not necessarily require the particular order shown, or sequential order, to achieve desirable results. It will be readily understood to those skilled in the art that various other changes in the details, materials, and arrangements of the parts and method stages which have been described and illustrated in order to explain the nature of this inventive subject matter may be made without departing from the principles and scope of the present disclosure.

What is claimed is:

1. A projectile assembly for a modular, low-lethal ammunition system comprising, a capsule tube configured to hold an effective compound,
- wherein said capsule tube has a closed, rounded end and an open end,
- wherein an aperture of said open end allows for an internal cavity of said capsule tube to be filled with said effective compound,
- wherein walls of said capsule tube are configured to break when said capsule tube strikes a target, a sealing member comprising a buffer unit and a capsule plug removably secured to said sealing member,
- wherein a catch located on said walls of said capsule tube at said open end is configured to secure to a groove of said capsule plug in order to hold said capsule plug within said aperture,
- wherein said buffer unit is configured to secure to said capsule tube at said open end,
- wherein a main body of said buffer unit is configured to secure against a projectile mounting area of an external shell,
- wherein a friction force created between said main body and said projectile mounting area prevents said main body from moving when secured within said external shell.

2. The projectile assembly of claim 1, wherein said main body of said buffer unit forms a widest point of said buffer unit and said capsule tube.

3. The projectile assembly of claim 2, wherein said main body comprises at least two conical sealing sections, wherein said at least two conical sealing sections form said widest point of said main body.

4. The projectile assembly of claim 3, wherein said at least two conical sealing sections are configured to make contact with said projectile mounting area in way that creates enough of said friction force to prevent said buffer unit from moving within said external shell without an external force applied thereto.

5. The projectile assembly of claim 3, wherein said at least two conical sealing sections are spaced in a way such that when a first conical sealing section enters a barrel of a firearm that a second conical sealing section is still in contact with said projectile mounting area of said external shell.

6. The projectile assembly of claim 5, wherein said at least two conical sealing sections are spaced no more than one inch apart.

7. The projectile assembly of claim 1, wherein a base end of said main body has a concave shape.

8. The projectile assembly of claim 1, wherein said buffer unit further comprises a notched portion and a tapered portion, wherein said notched portion connects said tapered portion to said main body, wherein a width of said notched portion forms a narrowest point of said buffer unit.

9. The projectile assembly of claim 8, wherein said tapered portion and said notched portion of said buffer unit are configured to secure to said capsule plug via an insertion hole of said capsule plug.

10. The projectile assembly of claim 1, wherein said capsule tube and said sealing member combine to create a sealed projectile assembly having said effective compound sealed within said internal cavity of said capsule tube.

11. The projectile assembly of claim 1, further comprising a plurality of shallow grooves on said walls of said capsule tube, wherein said plurality of shallow grooves cause said walls to more easily break when said capsule tube strikes said target.

12. A projectile assembly for a modular, low-lethal ammunition system comprising, a capsule tube configured to hold an effective compound, wherein said capsule tube has a closed, rounded end and an open end, wherein an aperture of said open end allows for an internal cavity of said capsule tube to be filled with said effective compound, wherein walls of said capsule tube are configured to break when said capsule tube strikes a target, a sealing member comprising a buffer unit and a capsule plug removably secured to said sealing member, wherein said capsule plug is configured to secure within said aperture of said capsule tube in a way such that it seals said effective compound within said internal cavity, wherein said buffer unit is configured to secure to said capsule tube at said open end, wherein a main body of said buffer unit is configured to secure against a projectile mounting area of an external shell, wherein a base end of said main body has a concave shape, wherein said main body comprises at least two conical sealing sections, wherein said at least two conical sealing sections are configured to make contact with said projectile mounting area of an external shell.

13. The projectile assembly of claim 12, wherein said at least two conical sealing sections are spaced no more than one inch apart.

14. The projectile assembly of claim 12, wherein said buffer unit further comprises a notched portion and a tapered portion, wherein said notched portion connects said tapered portion to said main body, wherein a width of said notched portion forms a narrowest point of said buffer unit.

15. The projectile assembly of claim 14, wherein said tapered portion and said notched portion of said buffer unit are configured to secure to said capsule plug via an insertion hole of said capsule plug.

16. The projectile assembly of claim 12, further comprising a plurality of shallow grooves on said walls of said capsule tube, wherein said plurality of shallow grooves cause said walls to more easily break when said capsule tube strikes said target.

17. A projectile assembly for a modular, low-lethal ammunition system comprising, a capsule tube configured to hold an effective compound, wherein said capsule tube has a closed, rounded end and an open end, wherein an aperture of said open end allows for an internal cavity of said capsule tube to be filled with said effective compound, wherein walls of said capsule tube are configured to break when said capsule tube strikes a target, a sealing member comprising a buffer unit and a capsule plug removably secured to said sealing member, wherein said capsule plug is configured to secure within said aperture of said capsule tube in a way such that it seals said effective compound within said internal cavity, wherein said buffer unit is configured to secure to said capsule tube at said open end, wherein a main body of said buffer unit is configured to secure against a projectile mounting area of an external shell, wherein said buffer unit further comprises a notched portion and a tapered portion, wherein said notched portion connects said tapered portion to said main body, wherein a width of said notched portion forms a narrowest point of said buffer unit, wherein said tapered portion and said notched portion of said buffer unit are configured to secure to said capsule plug via an insertion hole of said capsule plug, wherein at least two conical sealing sections of said main body form a widest point of said buffer unit, wherein said at least two conical sealing sections are configured to make substantial contact with said projectile mounting area of an external shell in way such that a friction force prevents movement of said buffer unit within said external shell unless an external force is applied to said buffer unit.

18. The projectile assembly of claim 17, wherein a base end of said main body has a concave shape.

19. The projectile assembly of claim 17, wherein said at least two conical sealing sections are spaced in a way such that when a first conical sealing section enters a barrel of a firearm that a second conical sealing section is still in contact with said projectile mounting area of said external shell.

20. The projectile assembly of claim 17, further comprising a plurality of shallow grooves on said walls of said capsule tube, wherein said plurality of shallow grooves cause said walls to more easily break when said capsule tube strikes said target.

* * * * *